US005251343A

United States Patent [19]

Goettl

[11] Patent Number: 5,251,343

[45] Date of Patent: Oct. 12, 1993

[54] SWIMMING POOL POP-UP FITTING

[75] Inventor: John M. Goettl, Phoenix, Ariz.

[73] Assignee: Paramount Leisure Industries, Inc., Scottsdale, Ariz.

[21] Appl. No.: 880,086

[22] Filed: May 5, 1992

[51] Int. Cl.[5] ..... E04H 4/16; B05B 3/16

[52] U.S. Cl. ..... 4/490; 4/492; 239/204; 239/206

[58] Field of Search ..... 4/490, 492; 239/203, 239/204, 205, 206, 446, 447

[56] References Cited

U.S. PATENT DOCUMENTS

| | | | |
|---|---|---|---|
| 1,180,170 | 4/1916 | Marsh et al. . | |
| 1,919,244 | 7/1933 | Munz . | |
| 1,964,269 | 6/1934 | Munz | 299/18 |
| 2,214,852 | 9/1940 | Mulhall | 299/61 |
| 2,509,076 | 5/1950 | Royer | 299/61 |
| 2,611,644 | 9/1952 | Burdick | 299/61 |
| 2,619,105 | 11/1952 | Hauser | 137/119 |
| 2,678,845 | 5/1954 | Fitter | 299/69 |
| 2,793,908 | 5/1957 | Carver, Jr. | 299/27 |
| 2,845,302 | 7/1958 | Hanf | 299/61 |
| 2,909,325 | 10/1959 | Hunter | 239/97 |
| 2,924,174 | 2/1960 | McLean | 102/49 |
| 2,935,266 | 5/1960 | Coleondro et al. | 239/456 |
| 3,018,788 | 1/1962 | Perlis | 137/331 |
| 3,035,778 | 5/1962 | Kimbro et al. | 239/206 |
| 3,045,829 | 7/1962 | Rule et al. | 210/169 |
| 3,117,724 | 1/1964 | Ray | 239/97 |
| 3,127,110 | 1/1964 | Reynolds | 239/204 |
| 3,247,969 | 4/1966 | Miller | 210/169 |
| 3,275,247 | 9/1966 | Hammelmann | 239/447 |
| 3,301,489 | 1/1967 | Tropeano et al. | 239/206 |
| 3,408,006 | 10/1968 | Stanwood | 239/66 |
| 3,449,772 | 6/1969 | Werner | 4/172 |
| 3,506,489 | 4/1970 | Baker | 134/10 |
| 3,515,351 | 6/1970 | Costa | 239/206 |
| 3,521,304 | 7/1970 | Ghiz | 4/172.16 |

FOREIGN PATENT DOCUMENTS 2543464 4/1977 Fed. Rep. of Germany .

(List continued on next page.)

*Primary Examiner*—Henry J. Recla
*Assistant Examiner*—Charles R. Eloshway
*Attorney, Agent, or Firm*—J. F. McLellan

[57] ABSTRACT

A swimming pool pop-up fitting having a pop-up head responsive to the intermittent application of water under pressure to reciprocate between retracted and projected positions for directing a jet of water over the adjacent inner surface of a swimming pool from a nozzle in the head.

The pop-up fitting includes a fixed retainer having cams that are engageable by camming pins carried by the nozzle head to incrementally rotate the head during its movement between retracted and projected positions. The pins can be removed and the head constrained against rotation to convert the head from a rotary head to a pop-up head which is rotationally stationary or fixed.

The pop-up head includes a stem which mounts the nozzle. The nozzle has diametrically opposed nozzle openings which are selectively alignable with an opening in the stem. Location of an insert in one of the nozzle openings reduces its diameter so that selective positioning of the nozzle insert adjacent the stem opening converts the fitting from a high water flow rate to a lower water flow rate.

The nozzle is retractable into a relatively large diameter nozzle recess located above a smaller stem recess which receives the stem. The wall defining the nozzle recess is provided with camming surfaces or cams which, because of the ample space available, are made relatively large and consequently more durable and more sensitive to the camming action of the nozzle pins. Also, location of the cams in the large nozzle recess presents a minimum obstruction to water flow and promotes higher water flow rates through the fitting.

14 Claims, 3 Drawing Sheets

U.S. PATENT DOCUMENTS

| | | | |
|---|---|---|---|
| 3,934,820 | 1/1976 | Phaup | 239/205 |
| 4,091,997 | 5/1978 | Ridgway | 239/206 |
| 4,188,673 | 2/1980 | Carter | 4/172.17 |
| 4,200,230 | 4/1980 | Gould | 239/66 |
| 4,202,499 | 5/1980 | Mathews | 239/206 |
| 3,567,126 | 3/1971 | Martini | 239/206 |
| 3,675,252 | 7/1972 | Ghiz | 4/172.16 |
| 3,722,816 | 3/1973 | Stewart et al. | 239/17 |
| 3,770,203 | 11/1973 | Dyar | 239/205 |
| 3,782,630 | 1/1974 | Sabo | 239/70 |
| 3,794,245 | 2/1974 | Wilson | 239/206 |
| 4,212,088 | 7/1980 | Goettl et al. | 4/490 |
| 4,271,541 | 6/1981 | Mathews | 4/490 |
| 4,322,860 | 4/1982 | Gould | 4/490 |
| 4,347,979 | 9/1982 | Mathews | 239/206 |
| 4,371,994 | 2/1983 | Mathews | 4/490 |
| 4,391,005 | 7/1983 | Goettl | 4/490 |
| 4,462,546 | 7/1984 | Pitman | 239/97 |
| 4,466,142 | 8/1984 | Gould | 4/490 |
| 4,486,907 | 12/1984 | Carter | 4/490 |
| 4,784,325 | 11/1988 | Walker et al. | 239/204 |
| 4,848,667 | 7/1989 | Dyck | 239/446 |
| 4,896,384 | 1/1990 | Dijkhuizen | 4/490 |
| 4,939,797 | 7/1990 | Goettle | 4/490 |

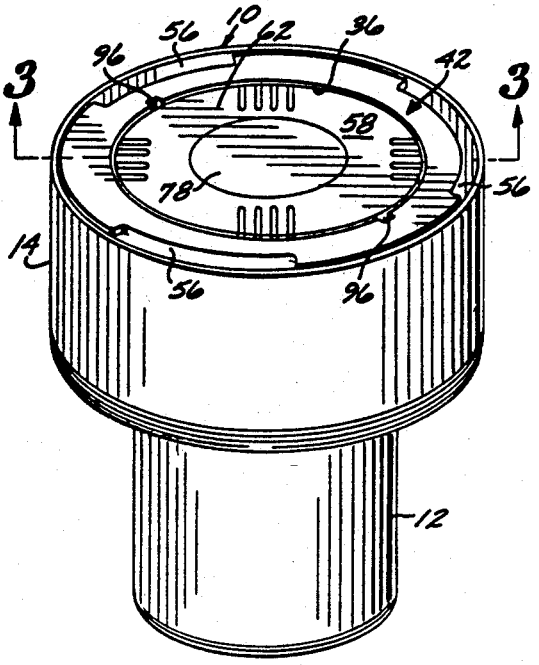
FIG. 1
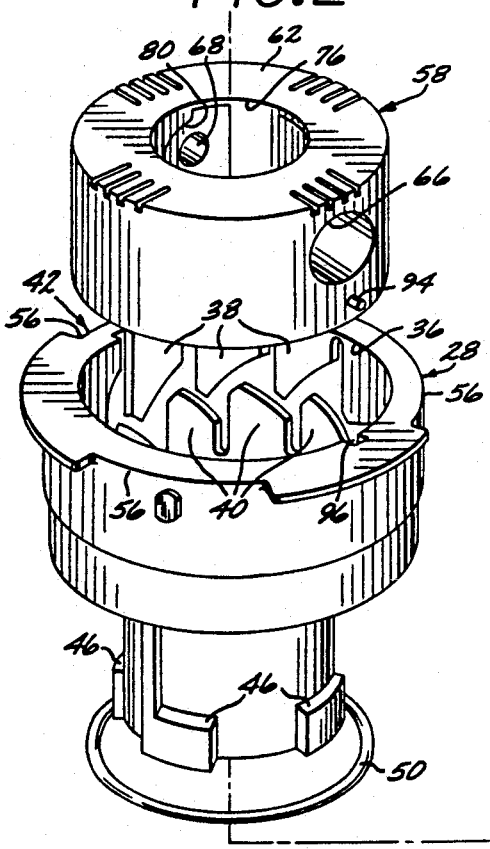
FIG. 2
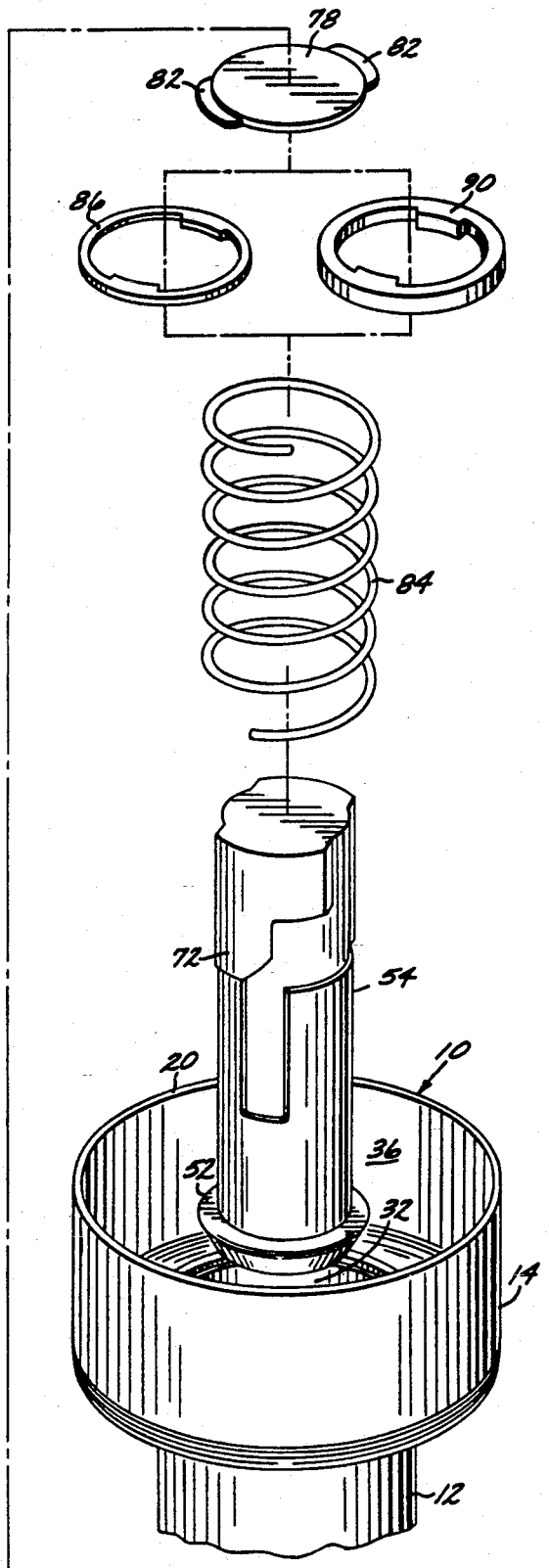

SWIMMING POOL POP-UP FITTING

BACKGROUND OF THE INVENTION

1. Field of the Invention

The present invention relates to swimming pool pop-up fittings, and particularly to pop-up fittings that incorporate indexing or camming means adapted to positively, incrementally rotate the pop-up head of the fitting during projection and retraction of the head.

2. Description of the Prior Art

One of the more effective camming mechanisms for pop-up heads in a swimming pool cleaning system is disclosed in U.S. Pat. No. 3,408,006, issued to Stanwood on Oct. 29, 1968 for "Liquid Jet Producing Device".

The Stanwood device includes a cylindrical housing designed to be threaded onto the exterior surface of a water inlet pipe, the housing and pipe both eventually being embedded in the concrete of the associated pool wall.

A cylindrical stationary structure which includes camming surfaces is attached to the inside of the housing. The pop-up head of the device is fitted within the stationary structure and includes a nozzle and an attached stem which carries a transverse camming pin. The pin rides upon the camming surfaces to incrementally rotate the nozzle as the head moves between its projected and retracted positions under the influence of water cycled through the inlet pipe. When water flows to the head it pops up. When the water flow is stopped, a bias means in the form of a spring pulls the head down.

Water pressure in the upper position of the head is effective to hold or constrain the head against rotation. Typically the water flow is maintained long enough for the water stream or jet issuing from the nozzle to extend a considerable distance from the head to thereby cover a fairly large surface of the pool during successive cycles of projection and retraction of the head.

It is desirable that the length and outer diameter of the head be minimized to reduce its overall size. Otherwise, the cavity that must be formed in the concrete around the inlet pipe to receive the head and gain access to the inlet pipe becomes too large, perhaps so large as to affect the structural integrity of the pool wall. Of course, a bulky or large head is also more expensive to make, stock and transport.

In Stanwood the wall which carries the camming surfaces surrounds the stem of the head. This presents some problems. If the wall is made large and thick enough to enable the formation of generous size camming surfaces that are deep enough to properly engage and guide the camming pin, the head structure around the stem becomes larger or bulkier. On the other hand, if the wall is made relatively small in diameter, the resultant camming surfaces can become too small to be sensitively responsive to the action of the stem camming pin. Stated another way, if the amount of travel of a camming pin over camming surfaces during stem reciprocation is relatively short, it becomes difficult to impart precise, repetitive incremental rotations to the stem.

Small cams also tend to be delicate, and subject to premature wear and operational failure, and to clogging by dirt and grit in the water.

The camming pin of Stanwood also undesirably extends across the flow path of water through the stem. This arrangement of the pin provides structural integrity for the pin. If the pin were to be made in two parts extending from opposite sides of the stem, there would be no obstruction to the flow of water, but structural integrity would require that the thickness of the stem wall be increased. As previously indicated, this would undesirably increase the diameter of the stem, and therefore the overall size of the pop-up fitting, or it would reduce the inner diameter of the stem and this would reduce the water flow through the head.

U.S. Pat. No. 4,322,860, issued to Gould on Apr. 6, 1982 for "Pool Cleaning Head With Rotary Pop-up Jet Producing Element" discloses a camming means similar to that of Stanwood in that the camming means is located in the stem area of the pop-up head.

It is an object of the present invention to provide a pop-up head design particularly suited for use in systems such as that disclosed in my copending patent application Ser. No. 07/428,862, filed Oct. 30, 1989 and entitled "Method and Apparatus for Removing Sediment From a Pool". In that system a combination of rotatable and non-rotatable pop-up fittings are mounted flush with the walls or inner surfaces of a swimming pool. They are acted upon by water pressure to direct jets of water over adjacent surfaces of the pool to scrub or cleanse sediment and debris from such areas and urge it toward the main drain or other collection point for ultimate separation from the pool water.

As discussed in more detail in the application, the pop-up head of each of the rotatable or rotary fittings issues a stream of water which changes in angular direction with each successive actuation of the head. The stream sweeps a circular sector in the vicinity of the head and develops an area of local turbulence. The head of the fixed fitting does not rotate, instead producing a long duration or continuous stream of water which acts in a predetermined direction to establish a water "highway". This continuous stream picks up sediment suspended in the local areas of turbulence which are produced by the rotary heads. The sediment is thus urged toward a collection point such as the main drain.

In their projected positions, the heads of both the rotary and fixed fittings are constrained against rotation. As a result, the jet stream which each produces is relatively straight and of long duration so that its influence extends a greater distance than would be the case if the heads rotated.

To avoid using large pumps, or a multiplicity of pumps, the system of my copending application preferably includes a valving arrangement which is cyclically operated to apply the output of a main pump sequentially to the various rotary heads. It is optional to use the output of a second or booster pump to constantly apply water under pressure to the fixed heads to develop the longer duration water "highways" mentioned above.

Since both rotary and fixed heads are used in such a system, economies can be realized by using a pop-up fixture which can be quickly converted to serve as either a fixed head or a rotary head. Neither Stanwood nor Gould discloses such a convertible structure.

Similarly, economies can be achieved by providing a head whose output is adjustable. Thus, large capacity heads could be used to sweep relatively large, uninterrupted pool surfaces, whereas lesser capacity heads could be employed for smaller areas that require specific targeting, such as pool steps, benches, corners and spa steps. At present the capacity of a head can be changed by drilling out different sizes of nozzle opening, by providing different sizes of knock out openings in the head, by driving different orifice size nozzle plugs into a standard size nozzle opening, or by various similar means. However, none of these measures is entirely satisfactory because they are not capable of being done quickly, and they only provide a one-time adjustment which does not allow for convenient further changes in water flow rate. Moreover, the configuration of prior art heads often does not provide a relatively long nozzle, which is desirable to produce an efficient jet stream.

It is preferred by swimming pool installers to slip fit the lower end of the pop-up head housing into the open end of the water inlet pipe from which it receives its water. Among other advantages, the connection can be easily and quickly made using a slip fit glue joint, rather than a threaded connection. Further, a threaded joint requires that fresh concrete be cleared away from the inlet pipe down past the threaded end portion and of course the threaded portion would have to be cleaned of all concrete in readiness for later attachment of the pop-up head.

SUMMARY OF THE INVENTION

According to the present invention, there is provided a pop-up fitting having a pop-up head characterized by a relatively large diameter nozzle providing a relatively long nozzle path for producing an efficient jet stream. The head is further characterized by a smaller diameter stem, and a camming mechanism to incrementally rotate the head through angular sectors upon successive, intermittent application of water pressure to the head. The cams of the camming mechanism are relatively large. They are therefore durable and long wearing, and are operative to precisely incrementally rotate or index the head. Their large size minimizes sediment collection and clogging. They do not occupy space in the direct water flow path. This location promotes the highest possible water flow rate through the fitting.

The cams can be made relatively large by reason of their unique arrangement and location.

A stationary or fixed retainer which receives the head is itself fitted within a generally complementally formed housing. The lower portion of the housing is made relatively small in diameter so that its lower end will be adapted to slip into the end of the water riser or inlet pipe that supplies pressurized water from the pool pumping system. The housing above the inlet pipe is enlarged to provide a large diameter bowl shaped cavity. The housing is embedded along with the pipe in the finished pool structure, with its upper surface or edge flush with the adjacent pool wall surfaces.

The retainer is characterized by a smaller diameter lower portion which fits within the lower portion of the housing, and a larger diameter upper portion which fits within the upper portion of the housing. The lower and upper portions of the retainer define, respectively, a stem recess and a nozzle recess within which the stem and nozzle of the head are located.

The camming surfaces or cams are relatively large because they are not located in the constricted space adjacent the nozzle stem, but are formed in the cylindrical walls of the larger diameter upper portion or nozzle recess of the retainer.

The camming pin operative upon the cams is carried by the relatively large diameter nozzle, and not by the smaller diameter stem. Since the cams are relatively large, they are more rugged than would be the case if they were formed in the smaller diameter recess portion of the retainer, and they are consequently more long wearing and sensitively responsive to movements of the camming pin.

Location of the camming mechanism adjacent the nozzle rather than adjacent the stem eliminates the need to provide additional wall thickness in the retainer adjacent the stem area to mount the cams. This significantly improves water flow rates through the head. Moreover, the camming pins can now be located so as to extend outwardly from the nozzle for engagement with the adjacent cams formed in the walls of the nozzle recess. This arrangement allows the pins to be easily stabilized by the large diameter nozzle, and also permits the stem of the head to be made in one piece for structural integrity.

A thrust washer in the stem recess engages a washer seat provided in the wall of the stem recess. In one embodiment, a retraction spring is fitted upon the stem for moving the pop-up head down in the absence of water flow to the head. One end of the spring bears against a shoulder on the lower end of the stem, and the other end bears against the thrust washer. The washer includes a tab longitudinally slidably engageable with a keyway in the stem. This insures rotation of the washer with the stem, carrying the spring with it so that undesired windup of the spring is prevented. A larger diameter thrust washer can be substituted for the original washer so that it forcibly engages the wall of the stem recess. Upon removal of the camming pins from the nozzle, the washer will operationally constrain the head from rotating in any position. This has the effect of converting the head from a rotary head to a non-rotating or fixed head. However, since the thrust washer can be made to remain axially slidable relative to the stem, the fixed head can still pop up and down. Another feature of this arrangement is that during installation the nozzle can be forcibly rotated by hand to properly orient the head so that the jet of water issuing from the nozzle is accurately aimed.

The nozzle includes oppositely directed openings, and is removable from the stem in order to allow one or the other of these nozzle openings to be aligned with a stem passage communicating with the water supply. An insert having a relatively small passage through it can be placed in one of the nozzle openings so that when it is selected for alignment with the stem passage upon assembly of the nozzle to the stem, the head will be converted from a high water flow rate to a lower water flow rate. The assembled nozzle and stem maintain the insert in position.

Other aspects and advantages of the present invention will become apparent from the following more detailed description taken in conjunction with the accompanying drawings.

BRIEF DESCRIPTION OF THE DRAWINGS

FIG. 1 is a perspective view of the assembled pop-up fitting according to the present invention;

FIG. 2 is an exploded perspective view of the pop-up fitting of FIG. 1, illustrating the manner of assembly;

DESCRIPTION OF THE PREFERRED EMBODIMENTS

Figure 3:
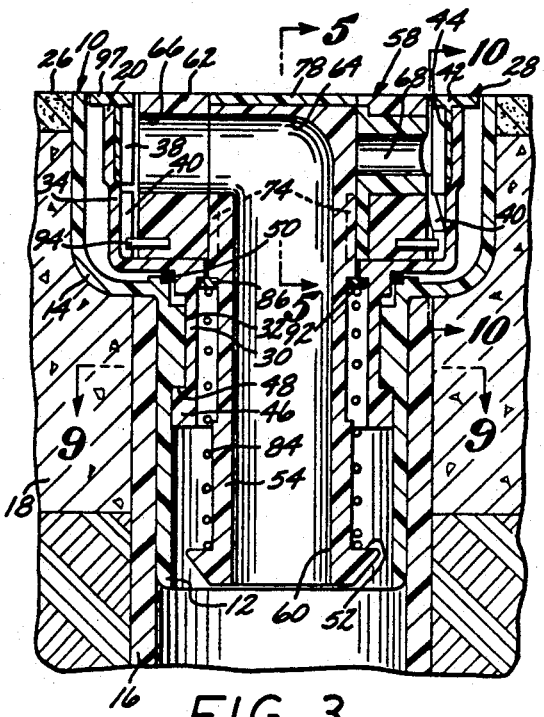
FIG. 3 is a view taken along the line 3—3 of FIG. 1, illustrating the pop-up head in its retracted position.

The swimming pool pop-up fitting of the present invention is especially suited for use with pool cleaning systems in which a combination of rotary and fixed pop-up fittings are embedded in pool surfaces such as the pool side walls and bottom. The pop-up heads of the fittings are supplied with water under pressure which the heads deliver in the form of streams or jets of water directed over the pool surfaces adjacent the heads. The action of the jets sweeping over such surfaces tends to urge debris and sediment to a collection point such as the pool main drain.

The heads are normally sequentially operated in order to maintain adequate pressure with a minimum capacity pump and a minimum number of pumps. Water from the pumping system is delivered to a sequencing valve which sequentially delivers water to a selected head or set of heads. An exemplary system is disclosed in my U.S. Pat. No. 4,212,088.

Unless otherwise indicated, each fitting component is preferably made of a high strength plastic material which is easily molded, and which can be adhesively secured to other components of the fitting when desired. Also, in the description and the claims which follow, "up", "down", "vertical", "horizontal" and like terms are not intended to be interpreted in a limited sense. Such terms are used as a matter of convenience to refer to the position and orientation of the pop-up fitting as it is illustrated in the drawings, and as it would be located, for example, in the bottom of a pool. Obviously, if the fitting were mounted in a side wall of the pool, the terms are to be interpreted accordingly.

Referring now to the drawings, and particularly to FIGS. 1-7 and 9-13, the present swimming pool pop-up fitting comprises, generally, a housing 10 having a cylindrical housing lower portion 12 and a much larger diameter cylindrical housing upper portion 14. The outer diameter of the housing lower portion 12 is made to fit within the open upper end of a water inlet pipe 16 for securement in that position by a suitable adhesive. If desired, the portion 12 could be threaded or otherwise secured to the pipe. The sequencing valve (not shown) of the pool pumping system is operative to intermittently supply water under pressure to the housing to pop the head of the fitting up and down.

Figure 14:
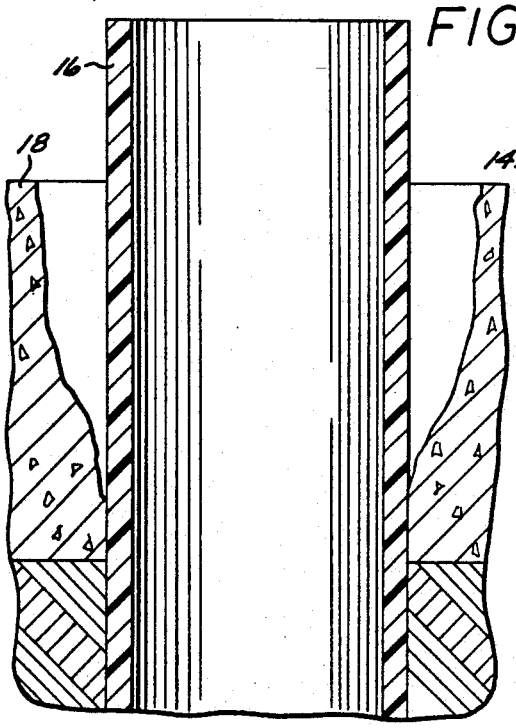
FIG. 14 is a longitudinal cross sectional view illustrating the water inlet pipe extending out of the freshly formed concrete, and with a generally bowl shaped cavity formed adjacent the pipe to receive the pop-up head housing;, and a cap inserted within the housing to facilitate formation of a plaster surface flush with the upper end of the housing.

In the initial installation stage, the inlet pipe 16 is cut off at a height well above the finish level of the adjacent pool wall surface, as seen in FIG. 14. In addition, the generally bowl shaped cavity which is illustrated is formed around the pipe to receive the housing 10.

Figure 15:
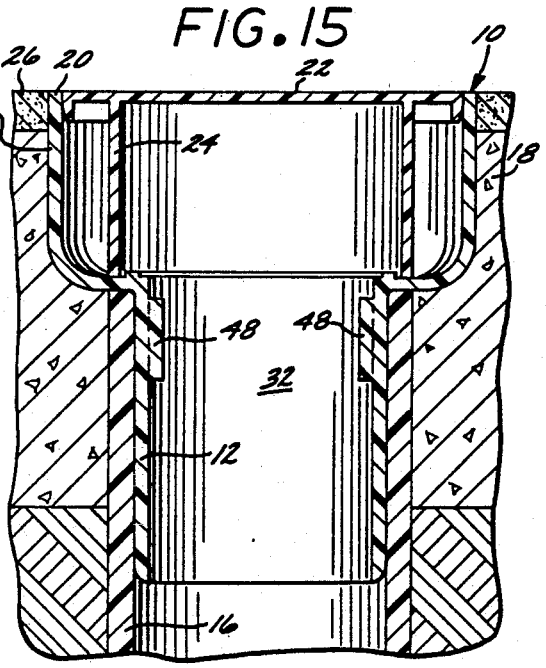
FIG. 15 is a view similar to FIG. 14, but illustrating the water pipe cut to the proper height, the housing lower end slip fitted and glued within the open end of the water pipe, with the larger upper portion of the housing located within the cavity seen in FIG. 14, with the cavity filled with patching concrete or the like, and with a cap inserted within the housing to protect the interior during application of the final plaster layer, which is also illustrated.

During the finishing stage, the pipe is cut off to the lower height seen in FIG. 15, the housing is fitted into place, and a circular cap 22 is fitted within the open upper end 20 to prevent construction debris from entering the housing. A depending flange or skirt 24 of the cap 22 rests upon the bottom of the bowl-like upper portion 14 to precisely locate the cap 22 flush with the upper end 20. Patching concrete or the like is then used to fill the previously formed cavity and surround the housing.

When installed, the underside of the upper portion 14 of the housing rests upon and extends radially outwardly of the pipe 16, and its upper edge extends above the surface of the rough concrete, as seen in FIG. 15. Once the patching concrete has set, a layer of plaster is trowelled to a level flush with the cap 22 to form a smooth pool surface 26. After the plaster layer has hardened, the cap 22 is easily popped out by routing water under pressure to the housing through the inlet pipe 16.

A retainer 28 having the general cylindrical contours of the housing 10 is complementally fitted within the housing interior. It comprises a retainer lower portion 30 defining a cylindrical, small diameter bore or stem recess 32, and a retainer upper portion 34 defining a cylindrical, much larger diameter bore or nozzle recess 36. As will be seen, the stem 54 and integral nozzle 66 of a pop-up head 58 are reciprocable in these recesses.

An annular cap 42 forms the upper part of the retainer upper portion 34. It is located flush with the adjacent housing upper end 20, and includes a depending wall 44 which is adhesively secured to the inner surface of the upper portion 34. The wall 44 and the wall of the upper portion 34 below it define the nozzle recess 36.

Figure 4:
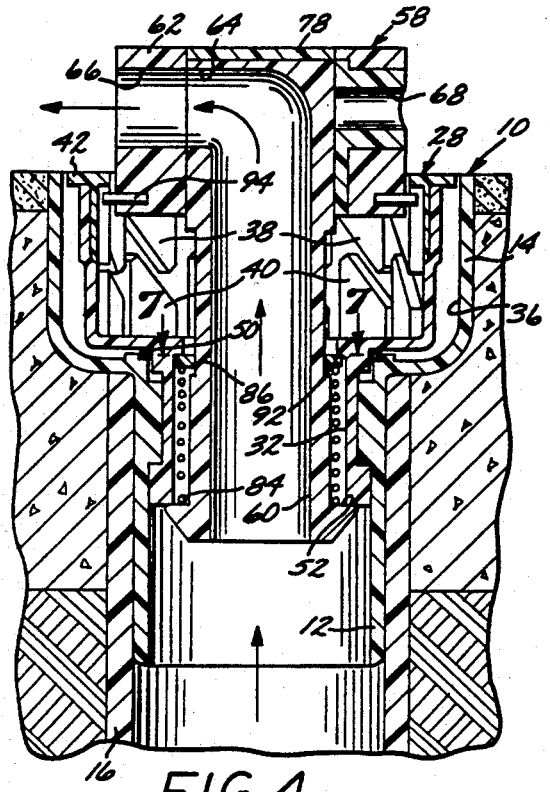
FIG. 4 is a view similar to FIG. 3, but illustrating the head in its extended position.
Figure 5:
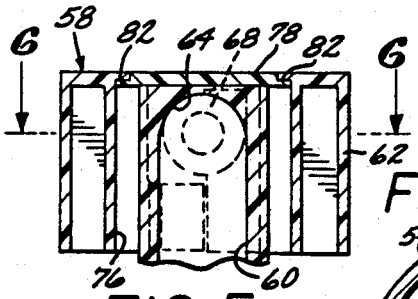
FIG. 5 is a view taken along the line 5—5 of FIG. 3.

A camming mechanism is operative to incrementally rotate the head 58 during its movement between the retracted and projected positions of FIGS. 3 and 4. The mechanism includes upper indexing surfaces or cams 38 formed in the cap wall 44, and lower indexing surfaces or cams 40 formed in the wall of the upper portion 34 below the cams 38. The cams are more easily injection molded in these separate pieces, which are thereafter adhesively assembled with the cams 38 and 40 disposed opposite one another in offset or staggered relation.

The large diameter of the wall of the nozzle recess 36 allows the cams 38 and 40 to be made large and relatively thick in section, rendering them rugged and long wearing.

Figure 9:
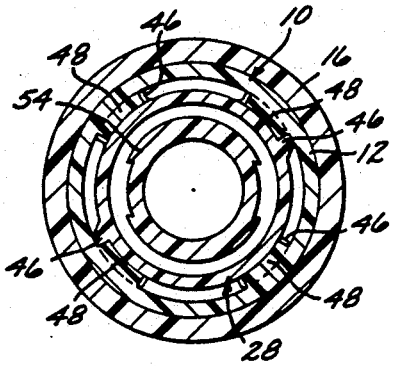
FIG. 9 is a view taken along the line 9—9 of FIG. 3.

The retainer 28 is releasably locked within the housing 10 by a bayonet-type of arrangement. As seen in FIG. 9, radially outwardly directed bayonet locking lugs 46 on the retainer lower portion 30 are engageable with complemental, radially inwardly directed bayonet locking lugs 48 provided on the interior surface of the housing lower portion 12.

The retainer and housing are assembled by downwardly sliding the lugs 46 through the grooves or spaces between the lugs 48, and then twisting the retainer by any suitable tool to rotate and frictionally wedge the lugs 46 beneath the lugs 48. The locked condition tends to be maintained by the resiliency of an O-ring 50 located between the housing upper portion 14 and the retainer upper portion 34. The O-ring also provides a fluid seal between the retainer and the housing.

As seen in FIG. 1, to facilitate insertion and removal of the retainer, the retainer cap 42 is provided with a plurality of circumferentially spaced apart openings 56 and intervening cap sections engageable by the complemental prongs of a locking tool or the like (not shown). A suitable tool for this purpose is described in detail in my U.S. Pat. No. 4,939,797, issued Jul. 10, 1990 for "Water Delivery Assembly for Cleaning Swimming Pools". In order to install or remove the retainer after the pool is filled with water, the tool includes a long handle for inserting the prongs through the openings 56. Subsequent rotation of the tool frictionally wedges the prongs beneath the cap sections between the openings 56, and continued rotation disengages the retainer lugs 46 from the housing lugs 48. The retainer can then be withdrawn and raised by the tool to the pool surface for maintenance or replacement. Insertion of the retainer is accomplished by reversing the steps just described.

The lower end of the retainer in its locked position acts as a stop to establish the upper limit of projection of the pop-up head. This is accomplished by engagement of the stop by a radial shoulder or spring seat 52 on the lower end of the stem 54 of the pop-up head.

The stem 54 includes a vertical central passageway 60 in communication with the water inlet pipe to supply water to the head. The upper extremely of the passageway 60 is curved and laterally directed to form a horizontal stem passage 64 alignable with one or the other of a pair of diametrically oppositely located and directed horizontal nozzle passages 66 and 68 provided in the nozzle 62. In the embodiment illustrated, the nozzle passage 66 is larger and is the one aligned with the stem passage 64. This provides a relatively high rate of water flow to project the water jet from the head 58 a greater distance, and thereby sweep over a larger sector of the adjacent pool surface 26 on actuation of the head.

When it is desired to provide a lower rate of water flow, such as would be sufficient for the water stream to reach small "problem" areas such as pool steps or the like, the stem 54 can be rotated to place the stem passage 64 out of alignment with the large nozzle 66 and into alignment with the other nozzle 68, whose smaller diameter is defined by the central aperture of a centrally apertured nozzle insert.

As seen in FIGS. 2, 3, 5 and 6, the stem 54 is provided with radially outwardly directed bayonet lobes or lugs 72. These are sized to be longitudinally slidable in the grooves or spaces between complemental, radially inwardly directed bayonet lugs 74 which are provided in a wall which defines a central opening 76 in the nozzle 62.

The stem is removed by twisting or partially rotating it relative to the nozzle 62. This unseats and disengages the lugs 72 from the lugs 74, allowing the stem to be moved downwardly out of engagement with the underside of a decorative escutcheon 78 which is seated within the nozzle central opening 76. The escutcheon 78, as seen in FIG. 2, includes laterally projecting tabs 82 which engage the underside of the nozzle upper wall adjacent the opening 76 to prevent the escutcheon from upwardly separating from the nozzle.

As seen in FIG. 2, the nozzle insert which defines the small diameter nozzle passage 68 is seated in a recess 80 formed in the nozzle wall adjacent the nozzle opening 68. The nozzle insert is sized and configured to be flush with the wall so that it is retained in position by the stem when the stem is assembled to the nozzle. However, it is easily popped inwardly for removal when the stem is separated from the nozzle. Also, the escutcheon, which is normally kept in position by the stem when the stem is assembled to the nozzle, can be popped inwardly and removed when the stem and nozzle are separated.

As previously indicated, the pop-up head 58 is responsive to the presence of water under pressure in the base of the stem recess 32 for raising the head from the retracted position of FIG. 3 to the projected position of FIG. 4. When water under pressure is not present in the stem recess, the head is moved to its retracted position by the action of retraction means which comprise a compression spring 84 engaged at its lower end upon the spring seat 52 of the stem, and engaged at its upper end upon a thrust washer 86. As will be apparent, the spring 84 is compressed upon movement of the head to its projected position, and the bias of the spring urges the head back to its retracted position upon the absence of pressurized water in the stem recess.

Figure 7:
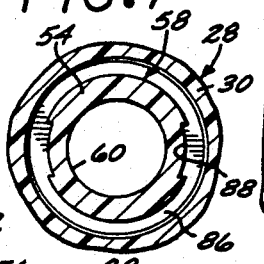
FIG. 7 is a view taken along the line 7—7 of FIG. 4.
Figure 6:
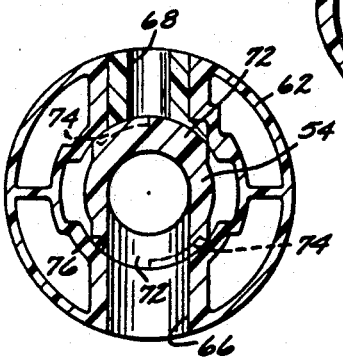
FIG. 6 is a view taken along the line 6—6 of FIG. 5.

The thrust washer 86 includes a pair of radially outwardly projecting tabs or lobes 88 which, as seen in FIG. 7, are longitudinally slidably received within complemental longitudinal splines formed in the stem. Further, the diameter of the thrust washer for a rotary type of pop-up head is less than the diameter of the adjacent wall of the stem recess. Consequently, the stem is freely reciprocable relative to the retainer.

Figure 8:
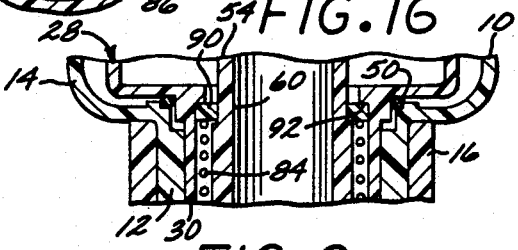
FIG. 8 is a portion of a view similar to FIG. 4, but illustrating the use of a larger diameter thrust washer disposed between the stem and the retainer.

As seen in FIGS. 2 and 8, a larger diameter thrust washer 90 can be substituted for the washer 86 to convert the pop-up head from a rotatable head to a non-rotatable or fixed head. This is accomplished by first removing the camming pins 94, as previously indicated, following which the engagement of the larger washer 90 with the adjacent wall of the stem recess prevents rotation of the stem relative to the retainer. The washer 90 remains free to slide longitudinally along the splines of the stem, enabling the stem to freely reciprocate when water under pressure is intermittently applied to the head 58.

The thrust washer 86 is seated upon the underside of an annular flange or washer seat 92 rotation of the washer with the stem tends to carry the spring 84 around with it. This avoids undesirable spring windup during incremental rotations of the head, which has been a problem with many pop-up heads of the prior art.

The cams 38 and 40 cooperate with a pair of camming pins 94 to index or incrementally rotate the head 58 as the head projects and retracts under the influence of applied water pressure upon intermittent application to the head of water under pressure. The pins are preferably made of stainless steel or some similar durable material and are mounted to and laterally project from the nozzle 62. On insertion of the nozzle 62 into the retainer 28 during assembly, the pins fit downwardly through a pair of slots 96 FIGS. 1–3, formed in an inwardly directed flange 97 of the retainer cap 42. Once the nozzle is inserted and partially rotated to lock the nozzle to the retainer, the pins 94 are prevented by the flange 97 from coming out of the retainer.

Referring now to FIGS. 10-13, each upper cam 38 includes vertical side edges 98 bounded at the top by the retainer cap flange 97. One of the side edges is longer than the other to define an inclined or sloping edge 100 connecting the two side edges. The side edge of each cam 38 is spaced from the side edge of the adjacent cam 38 to define a vertically elongated pocket or upper recess 102 adjacent the retainer cap flange 97.

Each lower cam 40 is similarly formed in that each includes vertical side edges 104, one of which is longer to define an inclined or sloping edge 106 connecting the two. The side edges are bounded at the bottom by the wall of the retainer formed by the transition between the retainer upper and lower portions 34 and 30. The side edge of each cam 40 is spaced from the side edge of the adjacent cam 40 to define a vertically elongated pocket or lower recess 108 adjacent the transition wall.

Figure 10:
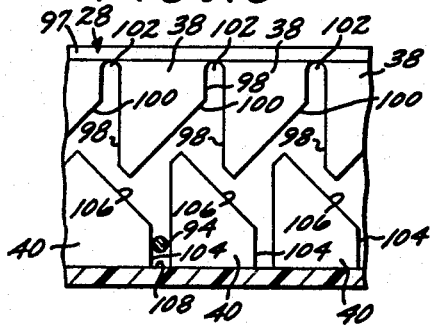
FIG. 10 is a view taken along the line 10—10 of FIG. 3.
Figure 11:
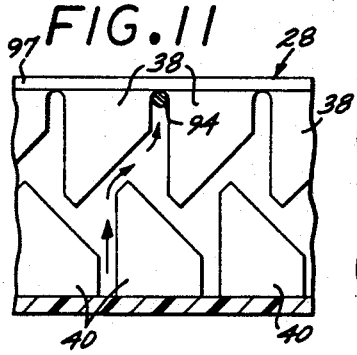
FIGS. 11—13 are views similar to FIG. 10, but illustrating the location of the camming pin relative to the cams through a cycle of head projection and retraction.

The cams 38 and 40 are offset so that the elongated pockets or recesses defined by one set of cams are generally vertically aligned with the sloping surfaces defined by the other set of cams. With this arrangement, when the head 58 is in its retracted position, the pins 94 are located within the lower recesses 108, as seen in FIG. 10. On movement of the head to its projected position under the influence of pressurized water acting against it, the pins engage the upper sloping surfaces 100 and ride upwardly and laterally along those surfaces and into the upper recesses 102, as seen in FIG. 11. The movement of the pins laterally incrementally rotates the nozzle relative to the retainer.

Figure 12:
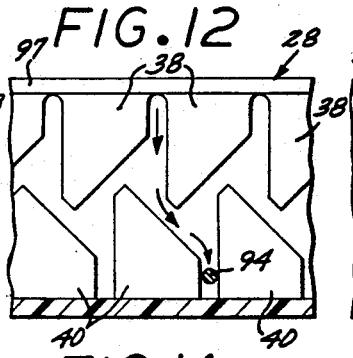
Figure 13:
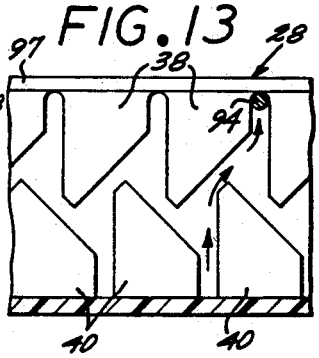

On cutoff of the pressurized water to the head, the bias of the spring 84 urges the head downwardly toward its retracted position, which causes the nozzle camming pins 94 to engage the lower sloping surfaces 106 and move downwardly and laterally to index or incrementally rotate the nozzle to which the pins are fixed, as seen in FIG. 12. The cycle of incremental rotation is repetitive, as seen in FIG. 13.

Location of the pins 94 in either the upper recesses 102 or the lower recesses 108 constrains the nozzle against rotation, which is desirable to keep the nozzle from creeping rotationally, particularly in the projected position of the head. In most instances the sequencing valve is operated to maintain the head in projected position for a significant period in order to develop a jet of water long enough to sweep over relatively large sectors of the pool.

The proximity of the cams to the water jets issuing out of the nozzles develops a scavenging or flushing action over the cams which, together with the absence of tiny crevices and recesses in the cams, enables the cams to be cleansed of dirt and sediment through the natural action of the nozzle.

Figure 16:
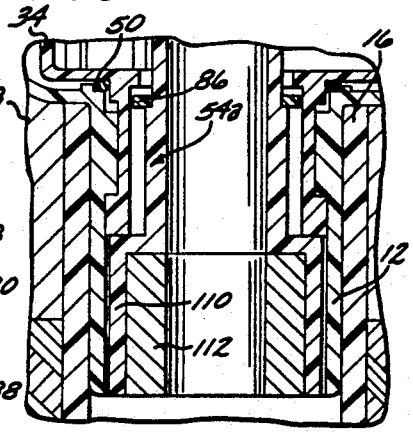
FIG. 16 is a view similar to FIG. 3, but illustrating an embodiment of the pop-up head in which the retraction means is not a spring, but instead is a weight to pull the head down in the absence of water flow.

Referring now to FIG. 16, there is illustrated an embodiment of the pop-up head in which the retraction of the head is not accomplished by the spring 84. The spring 84 is eliminated and a modified form of stem 54*a* is provided which is characterized by a generally cylindrical lower portion or skirt 110. The skirt 110 is approximately the diameter of the lower end portion of the stem of the first embodiment. It extends downwardly from the location of the spring seat 52 of the stem previously described to approximately the lower terminus of the housing 12.

The skirt 110 includes a cylindrical annulus or recess which receives a cylindrical weight 112 made of brass or stainless steel. The weight is press fitted or adhesively secured in position so it cannot fall out.

Alternatively, the weight could be placed in the head in any other location which is convenient, and which is operative to urge the head downwardly in the absence of water flow to the head. Likewise, all or part of the head could be made of a heavier material such as brass or the like to accomplish the same purpose.

Although the thrust washer 86 is illustrated in FIG. 16, it too could be eliminated if desired.

Other than the substitution of a weight for the spring 84, the operation of the two embodiments is essentially the same. Each has certain operational advantages over the other. The spring is less expensive, but the weight arrangement is simpler and perhaps more reliable. The weighted head also would not operate as well as the spring version when the pop-up head orientation is not completely vertical.

From the foregoing it will be seen that a pop-up fitting has been provided which is characterized by location of the cams of the camming mechanism in the large upper area of the stationary head retainer, and location of the camming pins on the large diameter nozzle of the head. The large cams that become available by this construction are much more durable, long wearing, and able to more precisely incrementally rotate the head. The nozzle size can be quickly changed to adjust the water flow capacity of the head. Further, removal of the camming pins accompanied by a rapid change in thrust washers quickly converts the head from a rotary head to a fixed head.

Various modifications and changes may be made with regard to the foregoing detailed description without departing from the spirit of the invention.

What is claimed is:

1. A swimming pool pop-up fitting comprising:

a housing having a cylindrical housing lower portion for attachment to a swimming pool water inlet pipe, and further having a cylindrical housing upper portion larger in diameter than the housing lower portion, the upper portion having an open end for mounting generally flush with a surface of the swimming pool;

a retainer removably fixed within the housing and having a cylindrical retainer lower portion and a cylindrical retainer upper portion larger in diameter than the retainer lower portion, the retainer lower and upper portions being located within the housing lower and upper portions, respectively, and defining, respectively, a cylindrical stem recess and a cylindrical nozzle recess which is larger in diameter than the stem recess;

first indexing means carried by the housing upper portion within the nozzle recess;

a pop-up head having a cylindrical stem and a cylindrical nozzle located within the stem recess and the nozzle recess, respectively, the nozzle being larger in diameter than the stem, the pop-up head being reciprocable between a retracted position wherein the nozzle is located within the nozzle recess, and a projected position wherein the nozzle is located above its retracted position for directing a jet of pressurized water over the adjacent surface of the swimming pool, the nozzle being adapted to carry second indexing means for cooperation with the first indexing means to incrementally rotate the pop-up head upon each projection and retraction of the pop-up head;

and retraction means operative to urge the pop-up head toward its retracted position.

2. A swimming pool pop-up head according to claim 1 wherein the retraction means comprises weight means in the head for urging the head toward its retracted position under the influence of gravity.

3. A swimming pool pop-up head according to claim 2 wherein the weight means takes the form of a material for at least a portion of the stem which is operative to sink in water.

4. A swimming pool pop-up head according to claim 2 wherein the weight means comprises a weight located in the lower portion of the stem.

5. A swimming pool pop-up fitting according to claim 1 wherein the wall of the stem recess includes a washer seat; a thrust washer in the stem recess frictionally engaged upon the washer seat; and wherein the stem includes longitudinally extending spline means mounting the thrust washer for free longitudinal slidable movement relative to the stem and for contemporaneous constraint of the thrust washer against rotation relative to the stem, and wherein the stem includes a spring seat; and wherein the retraction means comprises a compression spring having a lower extremity engaged upon the spring seat and an upper extremity engaged upon the thrust washer whereby rotation of the thrust washer with the stem tends to rotate the spring in common with the stem to thereby avoid spring windup during incremental rotations of the pop-up head.

6. A swimming pool pop-up fitting according to claim 5 wherein the diameter of the thrust washer is less than that of the stem recess whereby the thrust washer is freely reciprocable and freely rotatable relative to the retainer, and the pop-up head is correspondingly reciprocable and rotatable.

7. A swimming pool pop-up fitting according to claim 1 wherein the stem includes first locating means, and further includes a vertical water passage which is open at its lower end for communication with the water inlet pipe, and which is transversely directed at its upper end to define a horizontal stem passage; and wherein the nozzle includes a diametrically oppositely disposed first horizontal nozzle passage and a smaller second horizontal nozzle passage, the nozzle including second locating means cooperative with the first locating means in a first relative position of the stem and nozzle to fix the horizontal stem passage in alignment with the first horizontal nozzle passage, the second locating means being cooperative with the first locating means in a second relative position of the stem and nozzle to fix the horizontal stem passage in alignment with the second horizontal nozzle passage, whereby water may be selectively directed out of the aligned one of the first and second horizontal nozzle passages to adjust the quantity of water directed out of the pop-up head.

8. A swimming pool pop-up fitting according to claim 7 wherein the second horizontal nozzle passages is adapted to receive a cylindrical insert to reduce the size of the second horizontal nozzle passage.

9. A swimming pool pop-up fitting according to claim 8 wherein the nozzle adjacent the radially inwardly located end of the second horizontal nozzle passage includes a recess, and the insert includes a tab adapted to fit into the recess whereby the insert is fixed between the nozzle and the stem and thereby held in position within the second horizontal nozzle passage.

10. A swimming pool pop-up fitting according to claim 1 wherein the stem includes recesses, and the nozzle includes protuberances receivable in the recesses to lock the stem to the nozzle in a predetermined relative rotational and longitudinal position of the stem and nozzle.

11. A swimming pool pop-up fitting according to claim 1 wherein the upper horizontal wall of the nozzle includes a circular opening and the inner surface of the upper horizontal wall includes a recess adjacent the circular opening; the pop-up fitting further including a circular escutcheon having projecting tabs, the escutcheon being fitted within the circular opening flush with the upper surface of the upper horizontal wall, and with the tabs received in the recess adjacent the circular opening.

12. A swimming pool pop-up fitting according to claim 1 wherein the first indexing means comprise oppositely disposed and offset upper and lower sawtooth-like cams integral with the inner surface of the structure of the upper housing portion which defines the nozzle recess; and wherein the second indexing means comprise a pair of camming pins extending laterally for alternate engagement with the upper and lower cams as the pop-up head reciprocates between its projected and retracted positions for incrementally rotating the pop-up head.

13. In a swimming pool having structure defining an inner surface of a pool, and further having an inlet water pipe located in the pool structure inwardly of the inner surface, an improved swimming pool pop-up fitting comprising:

a housing having a cylindrical housing lower portion attached to the water inlet pipe, and further having a cylindrical housing upper portion larger in diameter than the housing lower portion, larger in diameter than the water inlet pipe, and extending above the water inlet pipe, the upper portion having an open end mounted generally flush with the inner surface of the swimming pool;

a retainer removably fixed within the housing and having a cylindrical retainer lower portion and a cylindrical retainer upper portion larger in diameter than the retainer lower portion, the retainer lower and upper portions being located within the housing lower and upper portions, respectively, and defining, respectively, a cylindrical stem recess and a relatively large diameter cylindrical nozzle recess located above the stem recess;

oppositely disposed and offset upper and lower sawtooth-like cams formed in the inwardly facing wall of the nozzle recess;

a pop-up head having a cylindrical stem and a cylindrical nozzle located within the stem and nozzle recesses, respectively, the nozzle being larger in diameter than the stem, the pop-up head being reciprocable between a retracted position wherein the nozzle is located within the nozzle recess, and a projected position wherein the nozzle is located above its retracted position for directing a jet of pressurized water over the adjacent surface of the swimming pool;

a pair of camming pins carried by the nozzle and extending laterally into alternate engagement with the upper and lower cams as the pop-up head reciprocates between its projected and retracted positions for incrementally rotating the pop-up head; and;

retraction means operative to urge the pop-up head toward its retracted position.

14. A swimming pool pop-up fitting comprising:

a housing having a cylindrical housing lower portion for attachment to a swimming pool water inlet pipe, and further having a cylindrical housing upper portion larger in diameter than the housing lower portion, the upper portion having an open end for mounting generally flush with a surface of the swimming pool;

a retainer removably fixed within the housing and having a cylindrical retainer lower portion and a cylindrical retainer upper portion larger in diameter than the retainer lower portion, the retainer lower and upper portions being located within the housing lower and upper portions, respectively, and defining, respectively, a cylindrical stem recess and a cylindrical nozzle recess which is larger in diameter than the stem recess, the stem recess having a wall which includes a washer seat;

a thrust washer in the stem recess frictionally engaged upon the washer seat, the diameter of the thrust washer being great enough to establish frictional engagement between the thrust washer and the adjacent wall of the stem recess to constrain the pop-up head against rotation;

a pop-up head having a cylindrical stem and a cylindrical nozzle located within the stem recess and the nozzle recess, respectively, the stem mounting the thrust washer for free longitudinal movement relative to the stem and for contemporaneous restraint of the thrust washer against rotation relative to the stem, the stem including a spring seat, the nozzle being larger in diameter than the stem, the pop-up head being reciprocable between a retracted position wherein the nozzle is located within the nozzle recess, and a projected position wherein the nozzle is located above its retracted position for directing a jet of pressurized water over the adjacent surface of the swimming pool; and retraction means operative to urge the pop-up head toward its retracted position, the retraction means comprising a compression spring having a lower extremity engaged upon the spring seat and an upper extremity engaged upon the thrust washer.

* * * * *